US007175171B1

(12) United States Patent
Lalicata

(10) Patent No.: US 7,175,171 B1
(45) Date of Patent: Feb. 13, 2007

(54) SUPPORT FOR PARALLELS FOR VISES USED IN MANUFACTURING

(76) Inventor: Salvator F. Lalicata, 21118 Bellbrook, Covina, CA (US) 91724

( * ) Notice: Subject to any disclaimer, the term of this patent is extended or adjusted under 35 U.S.C. 154(b) by 0 days.

(21) Appl. No.: 11/154,233

(22) Filed: Jun. 16, 2005

Related U.S. Application Data

(60) Provisional application No. 60/589,911, filed on Jul. 20, 2004.

(51) Int. Cl.
*B25B 1/24* (2006.01)

(52) U.S. Cl. ..... 269/277

(58) Field of Classification Search ..... None
See application file for complete search history.

(56) References Cited

U.S. PATENT DOCUMENTS 4,589,621 A * 5/1986 Hunt et al. ..... 254/126

* cited by examiner

*Primary Examiner*—Robert C. Watson

(74) *Attorney, Agent, or Firm*—Norman Friedland

(57) ABSTRACT

Support mechanism for supporting parallels in a vise that includes an elongated flat base member having a magnet mounted on the bottom thereof in conjunction with the springs, hold one of the parallels against the solid jaw of the vice. Each of a pair of arms pivotally mounted at one of its ends by pins are pivotally mounted in the opposing ends of the base member and are spring loaded by a pair of springs mounted in complementary recesses formed in and at either end of the base member and in the adjacent arm adjacent to the pins. The pair of torsional springs surrounding each of said pins and bearing against the wall surfaces of the recesses in the base member and the respective arms urge the base member against one of the parallels and urge the ends of the other arms against the other of the parallels securing the parallels to the jaws of the vice. The parallels serve to adjust the height of the work piece so as to perform a manufacturing procedure thereto.

9 Claims, 2 Drawing Sheets

SUPPORT FOR PARALLELS FOR VISES USED IN MANUFACTURING

This application claims the benefits under 35 U.S.C. § 119(e) of the U.S. Provisional Patent Application No. 60/589,911 filed on Jul. 20, 2004.

FEDERALLY SPONSORED RESEARCH

None

TECHNICAL FIELD

This invention relates to parallels adapted to fit into vises for supporting a work piece to allow a machining operation thereon.

BACKGROUND OF THE INVENTION

As is well known by those skilled in the machining technology a plurality of work pieces that require true dimensions after machining the work piece must be held in a vise in the same place for all the parts being machined. The parallel supports the part in the vise so that it is at a predetermined height so that the machining operation can be carried out while producing like results for all the parts being processed. In situations where the dimension of the depth of the work piece is smaller than the depth of the jaws of the vise, the parallel fits into the vise and supports the work piece to a height where the machining operation can take place. Heretofore when the parallels are inserted in the vise they must be held into place and when compressed air is used to clean chips after a machining operations they will fall, blow away or the chips migrate between the parallel and the jaws of the vise.

There are available a sundry of methods used to support the parallel in the vice such as using spring material that is bent to fit between parallels or using compression springs that are inserted between the parallels. One such method employs a device which is a pair of elongated parallel arms that fit on the outside of the jaws and include a base member and a spring loaded intermediate member. These structures all have their short comings. For example the springs have limited range and many springs or sets of springs must be stored to fit each particular job which is not only cumbersome but unwieldy.

In some instances, doubled back tape is used to support the parallels and this tape is inserted between the parallels and the jaws. Oil in the machining degrades the adhesive in the tape, loosening the bond and eventually causing the bond to disintegrate. Further, when the tape is removed, the jaws and parallels must be cleaned which is a time consuming and tedious job.

SUMMARY OF THE INVENTION

The object of this invention is to provide improved apparatus that are spring loaded to support parallels against the jaws of a vise and effectively allow its use while require a minimum effort to clean the jaws and parallel after the machining operation. The spring loaded linkage system of this invention is not only easy to use and assemble and cleans readily, it can be easily stored and maintained.

The foregoing and other features of the present invention will become more apparent from the following description and accompanying drawings.

BRIEF DESCRIPTION OF THE DRAWINGS

FIGS. 3A, 3B, 3C, 3D, 3E and 3F are top views illustrating the displacement of the links of the spring loaded linkage support system of this invention from almost full open to almost full close and displacements in between.

These figures merely serve to further clarify and illustrate the present invention and are not intended to limit the scope thereof.

DETAILED DESCRIPTION OF THE INVENTION

Figure 1:
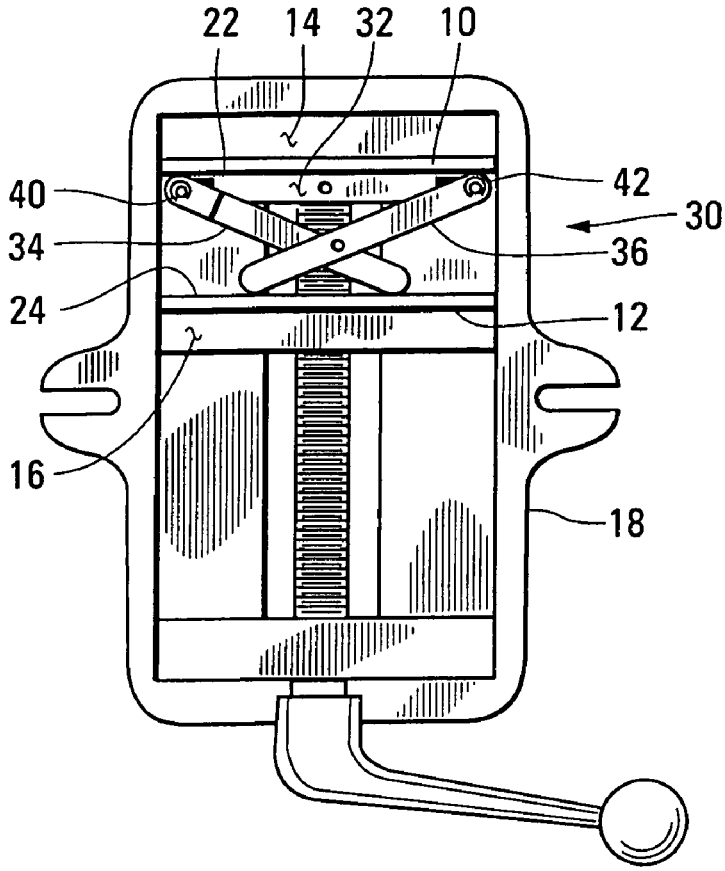
FIG. 1 is a plan top view of a vise with the parallels and spring loaded linkage support system of this invention is utilized.

As best seen in FIG. 1 the parallels 10 and 12 are supported against the jaws 14 and 16 of the vise 18. Vise 18 is a commercially available and standard vise used to support a work piece in order to perform a machining operation thereon. The work piece (not shown) lies on the top surfaces 22 and 24 of the parallels 10 and 12, respectively to elevate the work piece to a predetermined height within vise 18. Obviously, this is abundantly important when a plurality of work pieces are being processed and all require true dimensions when the machining operation is completed. The spring loaded linkage system of this invention generally illustrated by reference numeral 30 is mounted in between the jaws and bear against the parallels 10 and 12 to keep the parallels tight and snug against the jaws 14 and 16 of the vise 18.

As best seen from FIGS. 2 and 3A–3F, the spring loaded linkage system 30 comprises three (3) links or arms 32, 34 and 36. Link 32 is a base member and is fixed and includes a pair of magnets 38 suitably supported in recessed formed on the bottom surface of link 32 and serves to support through its magnetic force the spring loaded linkage system against the base of the vice 18. As will be explained in detail hereinbelow the magnets 38 removably secures the spring loaded linkage system 30 to vice 18 and the springs and arms 34 and 36 bias the parallels, which are mounted adjacent to the movable jaw 14 and fixed jaw 16 of the vise 18, toward the respective jaws 14 and 16.

Figure 2:
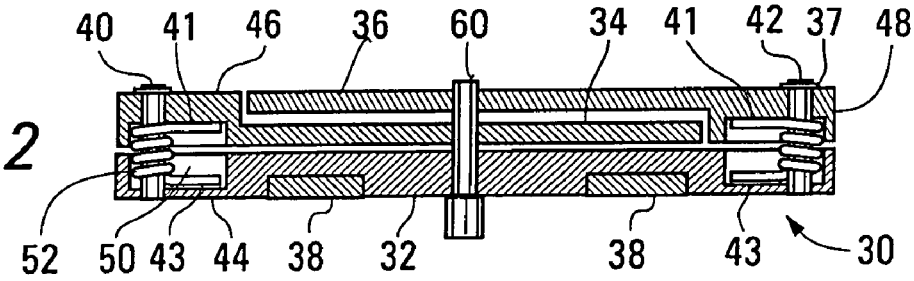
FIG. 2 is a view in side elevation and partially sectioned to show the details of this invention.
Figure 3A:
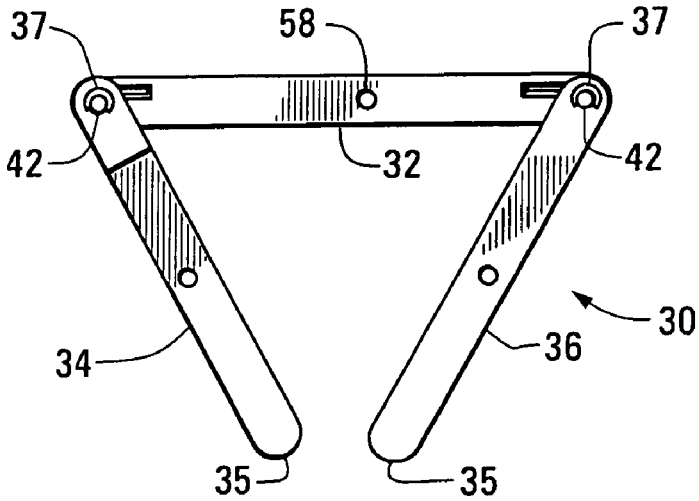
Figure 3B:
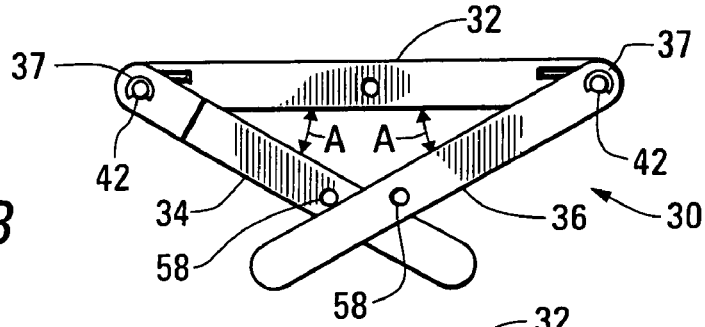
Figure 3C:
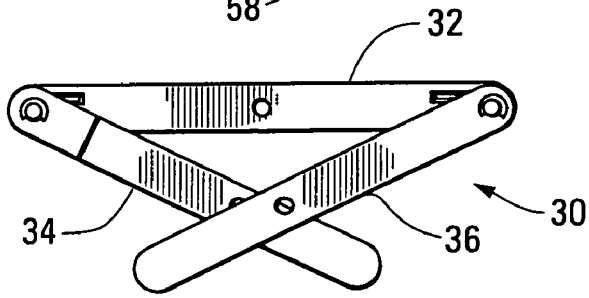
Figure 3D:
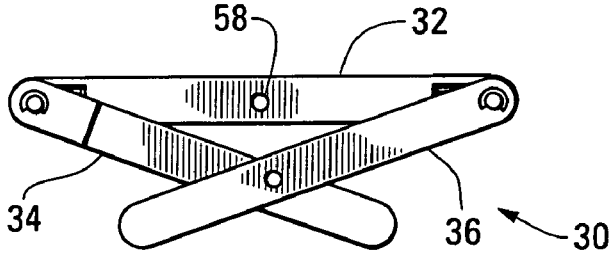
Figure 3E:
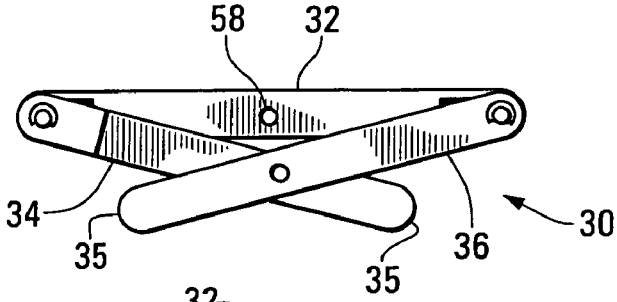
Figure 3F:
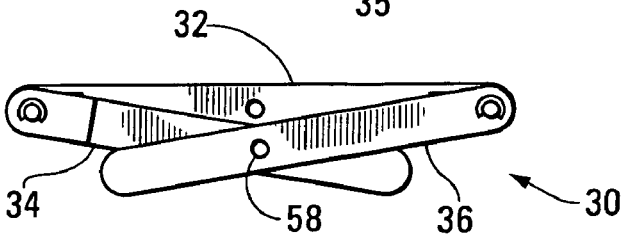
Figure 4:
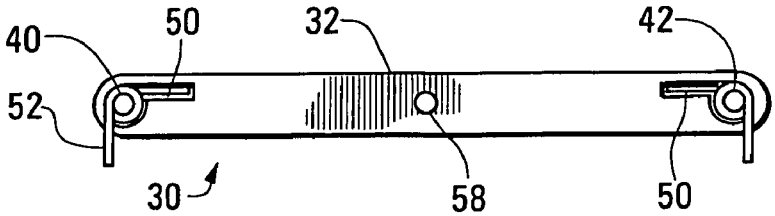
FIG. 4 is a partial view of the support apparatus with the rotating links removed for illustrating the torsional spring of this invention.

In accordance with this invention the links or arms 34 and 36 are pinned to the base link 32 at the ends thereof by pins or posts 40 and 42, respectively. Each of the posts include an annular slot at the end thereof which project beyond the respective arms 34 and 36 and receive a snap ring 37 for locking the pins 40 and 42 in place. As seen in FIG. 2 the ends of all the links 32, 34 and 36 have a projection end 44, 46 and 48 respectively and a cavity is formed therein to define a recess 50 on both ends of the linkage system. A pair of coiled torsion springs 52 are wrapped around the pins 40 and 42, respectively and the end portions 41 and 43 of springs 52 thereof fit into the respective recesses 50 and bear against the adjacent wall surface defining the recesses and urges the links 34 and 34 in a direction away from the base link 32 and toward the parallel on the opposite side as best depicted by the arrows A of FIG. 3B. Obviously, as the jaws are displaced, the spring loaded arm system, by virtue of the spring loaded arms 34 and 36 and much like a scissor motion, will force the parallels 10 and 12 against the jaws 14 and 16. Hence, the arms 34 and 36 will automatically adjust upon the opening and closing the jaws of the vice and the ends 35 and 35 (having the same dimension) so as to bear against the one of the parallels to exert a force on both of the parallels for each position of the jaws.

When in the stored mode, the arms are aligned and a central complimentary aperture 58 formed through each of the arms 32, 34, 36 receive a locking pin 60 having an enlarged diameter portion 62 serving as a handle to grasp the pin so as to pull it out of the complimentary apertures to allow the arms to expand.

What has been shown by this invention is a simple device that automatically adjust in scissors-like fashion to support the parallels and urge them against the respective jaws of the vice. The parallels serve to orient the the height of a work piece to allow a manufacturing operation on the work piece while being held by the vice. Obviously, when the work piece is removed from the vice, the area within the vice can easily be cleaned as by use of a blower or the like without disturbing or moving the parallels.

Although this invention has been shown and described with respect to detailed embodiments thereof, it will be appreciated and understood by those skilled in the art that various changes in form and detail thereof may be made without departing from the spirit and scope of the disclosed invention.

The invention claimed is:

1. Support apparatus for supporting parallels between the jaws of a vise, said support apparatus including three arms, one of the arms being a base member, each of said two of said three arms having a pin mounted on one end and extending through an aperture formed on either end of said base member for defining a pivot, complementary recesses formed in the opposing ends of said base member and each of said two arms adjacent to said pin, a torsional spring in said recess and surrounding said pin and having opposing ends, one of said opposing ends bearing against the wall surface of said recess of said base member and against the wall surface of the recess in each of said two arms for rotating said pin and said two arms for urging each of said two arms in a direction away from said base member to bear against the opposing parallel and exert a force on each of said parallels to urge each of said parallels against the wall surfaces of the jaws of the vise.

2. Support apparatus for supporting parallels between the jaws of a vise as claimed in claim 1, said base member having an elongated magnet fitted into a recess formed therein for attaching to the support apparatus to the base of the vise.

3. Support apparatus for supporting parallels between the jaws of a vise as claimed in claim 2, each of said pins extending beyond said first arm and said second arm, a slip ring mounted in a annular recess formed on each of said pins at the portion extending beyond said first arm and said second arm to hold said pins in place.

4. Support apparatus for supporting parallels between the jaws of a vise as claimed in claim 3 including a locking pin removably fitting into a plurality of complementary apertures formed in said three arms for locking said support apparatus in the non-deployment position.

5. Support apparatus for holding a pair of parallels against the jaws of a vise comprising, a first arm having a main planar elongated body including a projection portion on one end thereof, a second arm having a planar elongated body and being generally contiguous to said first arm when in the non-deployed position and being a base member, a pin extending between said first arm and said second arm located adjacent to the end of said first arm and said second arm, a torsional spring mounted in complementary recesses formed in said projection portion of said first arm and in said second arm for surrounding said pin and having one end portion thereof bearing against said first arm and another end portion thereof bearing against said second arm to rotate said first arm away from said second arm and when in the deployed position said second arm bears against one of said parallels and said torsional spring urges said first arm in a direction away from said second arm to allow the end thereof to bear against said opposite parallel to exert a force against the parallels and support said parallels against the jaws of the vise.

6. Support apparatus for supporting parallels between the jaws of a vise as claimed in claim 5 including another pin, a third arm having a main planar elongated body including a projection portion on one end thereof, another torsional spring mounted in complementary recesses formed in said projection portion of said third arm and said second arm for surrounding another pin, said pin having one end portion thereof bearing against said third arm and another end portion thereof bearing against said second arm to rotate said third arm away from said second arm and when in the deployed position said second arm bears against one of said parallels and said torsional spring urges said first arm and said third arm in a direction away from said second arm to allow the respective ends of said first arm and said second arm to bear against the opposite parallel to exert a force against the parallels and support said parallels against the jaws of the vise.

7. Support apparatus for supporting parallels between the jaws of a vise as claimed in claim 6, said base member having a pair of elongated magnets fitted into a recess formed therein for attaching said support apparatus to the base of the vise.

8. Support apparatus for supporting parallels between the jaws of a vise as claimed in claim 7, each of said pins extending beyond said first arm and said third arm, each of a pair of slip rings mounted in an annular recess formed on each of said pins at the portion extending beyond said first arm and said third arm to hold said pins in place.

9. Support apparatus for supporting parallels between the jaws of a vise as claimed in claim 8 including a locking pin removably fitting into a plurality of complementary apertures formed in said three arms for locking said support apparatus in a non-deployment position.

* * * * *